US006239761B1

(12) United States Patent
Guo et al.

(10) Patent No.: US 6,239,761 B1
(45) Date of Patent: May 29, 2001

(54) EXTENDED DIELECTRIC MATERIAL TAPERED SLOT ANTENNA

(75) Inventors: Yong Guo, Alhambra; G. Samuel Dow, Rancho Palos Verdes, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/415,097

(22) Filed: Oct. 8, 1999

Related U.S. Application Data

(63) Continuation of application No. 08/705,567, filed on Aug. 29, 1996, now abandoned.

(51) Int. Cl.[7] ..... H01Q 13/10; H01Q 1/38
(52) U.S. Cl. ..... 343/767; 343/770
(58) Field of Search ..... 343/767, 770; H01Q 1/38, 13/10

(56) References Cited

U.S. PATENT DOCUMENTS

| | | | |
|---|---|---|---|
| 3,508,276 | 4/1970 | Rope et al. | 343/785 |
| 3,518,691 | 6/1970 | Hallendorff | 343/785 |
| 4,516,129 | 5/1985 | Ittipiboon et al. | 343/772 |
| 4,607,685 | 8/1986 | Mitchell, Jr. | 165/80.3 |
| 4,622,559 | 11/1986 | Shafai et al. | 343/786 |
| 4,855,749 | 8/1989 | DeFonzo | 343/767 |
| 5,019,940 | 5/1991 | Clemens | 361/386 |
| 5,023,623 | 6/1991 | Kreinheder et al. | 343/725 |
| 5,036,335 | 7/1991 | Jairam | 343/767 |
| 5,070,340 | 12/1991 | Diaz | 343/767 |
| 5,081,466 | 1/1992 | Bitter, Jr. | 343/767 |
| 5,187,489 | 2/1993 | Whelan et al. | 343/767 |
| 5,248,987 | 9/1993 | Lee | 343/785 |
| 5,467,098 | 11/1995 | Bonebright | 343/767 |

OTHER PUBLICATIONS

"Antenna Engineering Handbook," (3rd Edition), by Richard C. Johnson, Editor McGraw–Hill, Inc. (1993) pp. 8–4 to 8–9.

*Primary Examiner*—Michael C. Wimer
(74) *Attorney, Agent, or Firm*—Robert W. Keller

(57) ABSTRACT

A tapered slot antenna (20) includes a dielectric (22) with a metallization layer (24) deposited on one side. The metallization layer (24) is etched to the dielectric substrate (22) to form a tapered slot (26, 28, 30, 32). In order to tune the antenna 20), for example, such that the E and H field beam width are symmetrical, the (22) extends beyond the wide portion of the slot as a dielectric loading (26, 28, 30, 32). A microstrip feed line (40, 42, 44, 46) is formed by a metallization deposit on an opposing side of the substrate (22). The microstrip feed line (40, 42, 44, 46) extends across a narrow portion of the tapered slot (26, 28, 30, 32) and is configured to optimize the coupling between the microstrip feed line (40, 42, 44, 46) and the tapered slot antenna (20).

25 Claims, 1 Drawing Sheet

EXTENDED DIELECTRIC MATERIAL TAPERED SLOT ANTENNA

This is a continuation of prior application Ser. No. 08/705,567, filed Aug. 29, 1996, abandoned, which is hereby incorporated herein by reference in its entirety.

BACKGROUND OF THE INVENTION

1. Field of the Invention

The present invention relates to a tapered slot antenna and, more particularly, to a tapered slot antenna with an extended dielectric substrate as a dielectric loading for tuning the E and H field beam width.

2. Description of the Prior Art

Tapered slot antennas are generally known in the art and used in various microwave communications systems. Examples of such tapered slot antennas are disclosed in U.S. Pat. Nos. 5,036,335; 5,081,466 and 5,187,489. Such tapered slot antennas are also discussed in Antenna Engineering Handbook, 3rd Edition, McGraw-Hill, Inc., pgs. 8.4–8.9 (1993).

Such tapered slot antennas are normally formed on a dielectric substrate by photolithography techniques. Such tapered slot antennas include a metallization layer formed on one side of the substrate. A portion of the metallization layer is etched away to the substrate to form a tapered slot that extends to the edge of the substrate. A microstrip feed line is formed on an opposite side of the substrate by way of a metallized strip. The metallized strip it positioned adjacent a narrow portion of the slot, formed on the opposite side of the substrate. A plated through hole or small diameter wire is known to be used to couple the microstrip feed to the tapered slot antenna formed on the opposing side of the dielectric. When used in receiver applications, incoming electric magnetic radiation is received by the tapered slot antenna and coupled to the microstrip feed line, which, in turn, is normally coupled to signal conditioning circuitry, such as a low noise amplifier.

Unfortunately, such tapered slot antennas have asymmetric radiation patterns. In other words, the H-plane beam width is relatively wider than the E-plane beam width. As such, the gain and the coupling efficiency of such tapered slot antennas is relatively low.

SUMMARY OF THE INVENTION

It is an object of the present invention to provide a tapered slot antenna which solves various problems in the prior art.

It is yet another object of the present invention to provide a tapered slot antenna with a symmetrical radiation pattern in order to increase the gain and coupling efficiency of the antenna.

Briefly, the present invention relates to a tapered slot antenna which may be formed by photolithography techniques which includes a dielectric substrate with a metallization layer deposited on one side. The metallization layer is etched to the dielectric to form a tapered slot. In order to tune the antenna, for example, such that the E and H fields are symmetrical, the substrate extends beyond the wide portion of the slot. A microstrip feed line is formed by a metallization deposit on an opposing side of the substrate. The microstrip feed line extends across a narrow portion of the tapered slot and is configured to optimize the coupling between the microstrip feed line and the tapered slot antenna.

BRIEF DESCRIPTION OF THE DRAWING

These and other objects of the present invention will be readily understood with reference to the following specification and attached drawing, wherein.

DETAILED DESCRIPTION OF THE INVENTION

Figure 1:
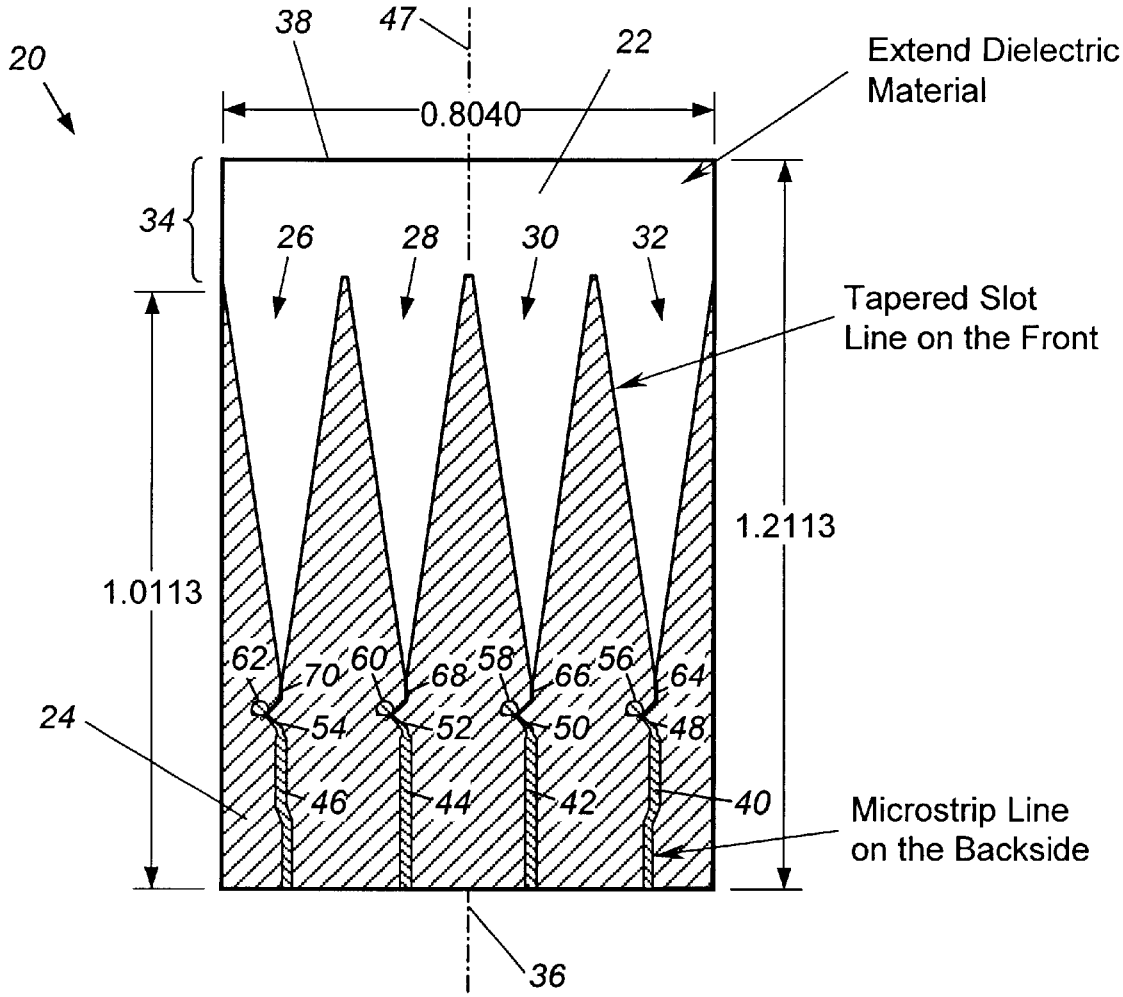
FIG. 1 is a top view of a tapered slot antenna in accordance with the present invention, illustrating a tapered slot antenna formed on one side of a dielectric substrate and a microstrip feed line formed on an opposing side of the substrate.

A tapered slot antenna in accordance with the present invention is generally identified with the reference numeral 20. The tapered slot antenna 20 provides for tuning of the E and H fields, for example, to provide for symmetrical radiation patterns to improve gain and coupling efficiency. As shown in FIG. 1, four tapered slot antennas are shown, formed on a single substrate. However, the principles of the present invention apply equally to single or other multiple tapered slot antennas formed on a single substrate.

The tapered slot antenna 20 may be formed from conventional photolithography techniques and includes a substrate 22 formed from a generally planar dielectric material. Suitable dielectric materials for use as the substrate 22, for example, duroid, having a thickness of 5 mil. A metallization layer 24 is deposited on one side of the substrate 22 to a thickness of 0.8 mil by a known metal deposition method, such as metal cladding. Various electrical conductive materials, such as copper, may be used for the metallization layer 24. As shown, the metallization layer 24 is etched to the substrate 22, for example, by photolithography to form a plurality of linearly tapered slots 26, 28, 30 and 32. As shown, the tapered slots 26, 28, 30 and 32 are formed as generally linear V-shaped slots. However, it will be appreciated by those of ordinary skill in the art that the principles of the present invention are also applicable to other slot geometries, such as exponentially tapered slot geometries, for example, as shown in U.S. Pat. No. 5,036,335.

An important aspect of the invention is an extended dielectric portion 34 which extends beyond the metallization layer 24. In known tapered slot antennas, for example, as disclosed in U.S. Pat. Nos. 5,081,466; 5,187,489; and 5,036,335, the metallization layer is normally extended between opposing ends of the substrate. In the present invention, in order to provide for tuning of the E and H field beam width, for example, to create a symmetrical radiation pattern in order to improve the gain and coupling efficiency of the antenna, the metallization layer 24 is not extended between opposing ends 36 and 38 of the substrate 22. Rather, the metallization layer 24 extends only partially between the opposing ends 36 and 38 to define the extended dielectric portion 34. The extended dielectric portion 34 acts as an impedance that can be used to tune the E and H fields of the antenna. In the example shown in FIG. 3, the total length of the substrate 22 is, for example, 1.213 inches, while the metallization layer 24 only extends 1.0113 inches from the end 36. The length of the extended dielectric portion 34 may be determined experimentally by forming antennas with different length metallizations in order to determine a length of the metallization which results in the desired radiation pattern, for example, a symmetrical radiation pattern.

A plurality of microstrip feed lines 40, 42, 44 and 46 are formed by way of a metallization layer on an opposing side of the substrate 22. The microstrip feed lines 40, 42, 44 and 46 enable the tapered slot antennas formed by the notches 26, 28, 30 and 32 to electromagnetically couple the tapered slot antennas to an external circuit (not shown). Each microstrip feed line 40, 42, 44 and 46 is formed to a thickness of .08 mil and formed as generally elongated conductors along an axis generally parallel to a longitudinal axis 47 of the substrate 22, extending from one edge 36 of the substrate 22. An opposing end of each of the microstrip feed lines 40, 42, 44 and 46 is formed with a reduced thickness portion 48, 50, 52 and 54 at an angle, for example 45°, with respect to the longitudinal axis 47. The ends of the reduced thickness portions 48, 50, 52 and 54 of the microstrip feed lines 40, 42, 44 and 46 are formed with circular portions 56, 58, 60 and 62, having a diameter of, for example, 20 mil.

Figure 2:
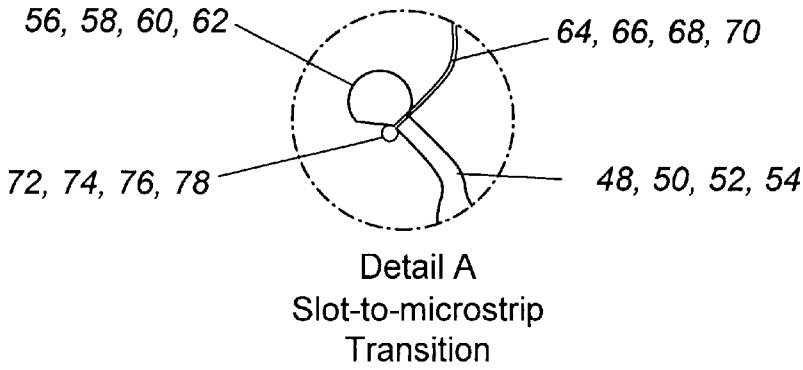
FIG. 2 is an enlarged partial view illustrating the slot to microstrip feed line transition.

As shown best in FIG. 2, non-tapered curved slot portions 64, 66, 68 and 70 are formed as extensions of the narrow end of the tapered slots 26, 28, 30 and 32. As shown in FIG. 2, the non-tapered curved slot portions 64, 66, 68 and 70 are formed as relatively narrow slots, having a width, for example, 2 mil and non-linear, formed for example by two linear portions formed end to end at an angle, for example 45° relative to one another, such that the cross-over point between the curved slot portions 64, 66, 68 and 70 and the reduced width portions 48, 50, 52 and 54 of the microstrip feed lines 40, 42, 44 and 46 cross at generally 90° relative to one another. Circular slots 72, 74, 76 and 78, having a diameter of, for example, 7 mil are formed at the end of the curved slot portions 64, 66, 68 and 70. The reduced thickness portions 48, 50, 52 and 54 short circuit the curved slot portions 64, 66, 68 and 70. There is no plating of 64, 66, 68, 70 at the cross-over point. The configuration of the microstrip feed lines 40, 42, 44 and 46 with the curved portions 56, 58, 60 and 62 of the slots provides optimal coupling between the tapered slot antennas formed by way of the notches 26, 28, 30 and 32 and an external circuit.

Obviously, many modifications and variations of dielectric loading of the present invention are possible in light of the above teachings. For example, shape variations of the extended dielectric substrate, i.e., changes of the thickness, width, or drilling holes as another form of the dielectric loading. Thus, it is to be understood that, within the scope of the appended claims, the invention may be practiced otherwise than as specifically described above.

What is claimed and desired to be secured by Letters Patent of the United States is:

1. A method for forming a tapered slot antenna having a predetermined E-field and H-field radiation pattern, the method comprising the steps of:

(a) providing a generally planar substrate having opposing sides formed from a predetermined dielectric material having a predetermined length and defining a predetermined axis;

(b) depositing a metallization layer on one side of said opposing sides of said substrate, said metallization layer formed with one or more tapered slots extending along said predetermined axis forming one or more tapered slot antennas, said metallization layer extending along said predetermined axis for less than said predetermined length of said planar substrate defining an extended dielectric portion which extends beyond said metallization layer, said length of said extended dielectric portion selected to tune the beam width of said E-field and H-field to provide a radiation pattern for said tapered slot antenna in which the E-field and H-field radiation patterns are symmetrical; and (c) forming a microstrip feed line on an opposing end of said tapered slot antenna.

2. The method as recited in claim 1, wherein said tapered slots are linearly tapered.

3. The method for forming a tapered slot antenna as recited in claim 1, wherein said metallization layer is formed from copper.

4. The method for forming a tapered slot antenna as recited in claim 1, wherein said tapered slots are linearly tapered.

5. The method for forming a tapered slot antenna as recited in claim 1, further including the step of forming a non-tapered slot portion adjacent said narrow end of said tapered slot.

6. The method for forming a tapered slot antenna as recited in claim 5, wherein said non-tapered slot portion is non-linear.

7. The method for forming a tapered slot antenna as recited in claim 6, wherein said non-tapered slot portion includes two linear potions formed end to end at a predetermined angle relative to one another.

8. The method for forming a tapered slot antenna as recited in claim 7, further including the step of forming a circular slot portion on an end of said non-tapered slot portion.

9. The method for forming a tapered slot antenna as recited in claim 5, wherein said microstrip feed line is configured to cross said non-tapered slot portion defining a cross-over at a predetermined angle.

10. The method for forming a tapered slot antenna as recited in claim 9, wherein said predetermined angle is substantially 90°.

11. The method for forming a tapered slot antenna as recited in claim 10, wherein said microstrip feed line includes a curved portion.

12. The method for forming a tapered slotted antenna as recited in claim 11, wherein said microstrip feed line is formed with a first predetermined width and said curved portion is formed with a second predetermined width.

13. The method for forming a tapered slot antenna as recited in claim 12, further including a circular portion formed on an end of said curved portion.

14. A tapered slot antenna deice having one or more tapered slot antennas for providing an E-field and an H-field radiation pattern comprising:

a generally planar substrate having opposing sides formed from a predetermined dielectric material haven a predetermined length and defining a predetermined axis;

a metallization layer formed on one side of said opposing sides of said substrate, said metallization layer formed with one or more tapered slots extending along said predetermined axis forming one or more tapered slot antennas, said metallization layer extending along said predetermined axis for less than said predetermined length of said planar substrate defining an extended dielectric material beyond said metallization layer, such that the E-field and H-field radiation patterns are symmetrical; and a microstrip feed line formed on an opposing side of said tapered slot antenna.

15. A tapered slot antenna as recited in claim 14, wherein said metallization layer is formed from copper.

16. A tapered slot antenna as recited in claim 14, wherein said tapered slots are linearly tapered.

17. A tapered slot antenna as recited in claim 14, in which a non-tapered slot portion is formed adjacent to one tapered portion.

18. A tapered slot antenna as recited in claim 17, wherein said non-tapered slot portion is non-linear.

19. A tapered slot antenna as recited in claim 18, wherein said non-tapered slot portion includes two linear portions formed end-to-end at a predetermined angle relative to another.

20. A tapered slot antenna as recited in claim 19, wherein a circular slot portion is formed on one end of the non-tapered slot portion.

21. A tapered slot antenna as recited in claim 17, wherein said microstrip feed line is configured to cross said non-tapered slot portion at a predetermined angle.

22. A tapered slot antenna as recited in claim 21, wherein said predetermined angle is substantially 90°.

23. A tapered slot antenna as recited in claim 22, wherein said microstrip feed line includes a curved portion.

24. A tapered slot antenna as recited in claim 23, wherein said microstrip feed line is formed with a first predetermined width and said curved portion is formed with a second predetermined width.

25. A tapered slot antenna as recited in claim 24, wherein a curved portion is formed on one end of said curved portion.

* * * * *